US008936514B2

(12) United States Patent
Sato

(10) Patent No.: US 8,936,514 B2
(45) Date of Patent: Jan. 20, 2015

(54) GOLF CLUB

(71) Applicant: Bridgestone Sports Co., Ltd., Tokyo (JP)

(72) Inventor: Fumiaki Sato, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 95 days.

(21) Appl. No.: 13/795,603

(22) Filed: Mar. 12, 2013

(65) Prior Publication Data

US 2013/0296068 A1 Nov. 7, 2013

(30) Foreign Application Priority Data

May 2, 2012 (JP) ..... 2012-105406

(51) Int. Cl.
*A63B 53/02* (2006.01)
*A63B 53/16* (2006.01)

(52) U.S. Cl.
USPC ..... 473/296; 473/288; 473/307; 473/309

(58) Field of Classification Search
USPC ..... 473/301, 309, 288, 244–248, 296
See application file for complete search history.

(56) References Cited

U.S. PATENT DOCUMENTS

| | | | | |
|---|---|---|---|---|
| 7,083,529 | B2 * | 8/2006 | Cackett et al. | 473/309 |
| 7,931,542 | B2 * | 4/2011 | Kusumoto | 473/288 |
| 7,997,997 | B2 * | 8/2011 | Bennett et al. | 473/288 |
| 8,235,837 | B2 * | 8/2012 | Bennett et al. | 473/307 |
| 8,272,972 | B2 * | 9/2012 | Sato et al. | 473/296 |
| 8,382,607 | B2 * | 2/2013 | Burnett et al. | 473/307 |
| 8,517,856 | B2 * | 8/2013 | Bennett et al. | 473/307 |
| 8,562,453 | B2 * | 10/2013 | Sato | 473/288 |
| 8,696,488 | B2 * | 4/2014 | Burnett et al. | 473/307 |
| 2014/0051527 | A1 * | 2/2014 | Sato | 473/307 |

FOREIGN PATENT DOCUMENTS

JP 2010-213859 A 9/2010

* cited by examiner

*Primary Examiner* — Stephen L. Blau
(74) *Attorney, Agent, or Firm* — Sughrue Mion, PLLC

(57) ABSTRACT

According to an aspect of this invention, a golf club includes: a shaft; a head attached to a distal end of the shaft; a substantially cylindrical shaft case is secured to the distal end of the shaft; the shaft case is inserted into a hosel hole in the head; and the shaft case is fixed to the head by a bolt which is inserted from a sole side of the head, wherein: a stopper member is attached to an outer circumference of the shaft case so that an attaching position can be changed; the stopper member is in abutment with an upper end portion of a hosel; and an inserting depth of the shaft case into the hosel hole can be changed by changing the attaching position of the stopper member.

7 Claims, 22 Drawing Sheets

GOLF CLUB

BACKGROUND

1. Field of the Invention

The present invention relates to a golf club and more particularly to a golf club which enables the adjustment of inserting depth of a shaft into a hosel.

2. Description of the Related Art

A golf club has a head which is attached to a distal end portion of a shaft. A grip is attached to a proximal end of the shaft.

In a conventional and general golf club head, a hosel hole is provided directly in the head, and a shaft is inserted into the hosel hole to be secured therein by an adhesive. In general, an epoxy based adhesive is used for the adhesive. In replacing shafts, a hosel portion is heated to break the texture of hardened epoxy resin, whereby the shaft can be pulled out of the hosel hole.

In this conventional and general golf club head, the inserting depth of the shaft cannot be changed.

As a golf club which enables the change of inserting depth of a shaft case, JP-A-2010-213859 describes a golf club in which a substantially cylindrical shaft case is secured to a distal end of a shaft, the shaft case is inserted into a hosel in a head from an upper end side of the hosel, and the shaft case is fixed to the hosel by first and second annular screw members which are detachably screwed to the upper end side of the hosel.

In the golf club described in the patent literature, a spacer is interposed between a lower end of the shaft case and a hosel bottom portion, and an internal screw thread is formed in an inner circumferential surface of the upper end side of the hosel. The first screw member is screwed in an upper end of the hosel concentrically with the hosel. An internal screw thread is formed in an inner circumferential surface of an upper end side of the first screw member, and an external screw thread on the second screw member is screwed in the internal screw thread of the first screw member. The inserting depth of the shaft is increased by removing the spacer and the first screw member and screwing the second screw member directly in the internal screw thread of the hosel.

In the golf club described in JP-A-2010-213859, since the inserting depth of the shaft is changed by attaching or detaching the screw member, it follows that the weight of the head changes inevitably in association with the change in the inserting depth of the shaft. An object of the invention is to provide a golf club which eliminates the necessity of attaching or removing a separate member every time the inserting depth of a shaft is changed.

Additionally, in the golf club described in JP-A-2010-213859, since the inserting depth of the shaft is changed by attaching or detaching the screw member, the adjustment of the inserting depth of the shaft is limited to the two stages.

SUMMARY

According to the invention, a golf club is provided which can change the inserting depth of the shaft in multiple stages or arbitrarily in one aspect thereof.

According to a first aspect of the invention, there is provided a golf club including: a shaft; a head attached to a distal end of the shaft; a substantially cylindrical shaft case is secured to the distal end of the shaft; the shaft case is inserted into a hosel hole in the head; and the shaft case is fixed to the head by a bolt which is inserted from a sole side of the head, wherein: a stopper member is attached to an outer circumference of the shaft case so that an attaching position can be changed; the stopper member is in abutment with an upper end portion of a hosel; and an inserting depth of the shaft case into the hosel hole can be changed by changing the attaching position of the stopper member.

The stopper member may have a cylindrical or ring shape, a bolt may be screwed in an internally screw threaded hole provided in the stopper member, and the bolt may be screwed to be advanced so that a distal end thereof is pressed against the shaft case, whereby the stopper member may be fixed to the shaft case.

In this case, the stopper member may have the cylindrical shape and may cover an outer circumferential surface and an upper end face of the shaft case which projects from the hosel.

A surface of an outer surface of the shaft case with which the bolt is brought into abutment may be a flat surface.

The surface with which the distal end of the bolt is brought into abutment may be a deep bottom surface of a groove which extends in a parallel direction to the direction of an axis of the cylindrical shaft case or a deep bottom surface of a projecting groove portion which projects sideways from the groove portion.

An inner circumferential surface of the hosel hole and an outer circumferential surface of the shaft case maybe made up of a non-cylindrical surface, and the shaft case may be prohibited to rotate relative to the hosel hole.

An external screw thread may be formed in an outer circumferential surface of an upper portion of the shaft case, and the stopper member may be a nut which is screwed on the external screw thread.

According to a second aspect of the invention, there is provided a golf club including: a shaft; a head attached to a distal end of the shaft; a substantially cylindrical shaft case is secured to the distal end of the shaft; the shaft case is inserted into a hosel hole in a hosel of the head; and the shaft case is fixed to the head by a bolt which is inserted from a sole side of the head, wherein: an elongated projecting portion is provided on an outer circumferential surface of an upper portion of the shaft case so as to extend in a parallel direction to an axis of the cylindrical shaft case; a recess portion in which the elongated projecting portion fits is provided in an upper end face of the hosel; and an inserting depth of the shaft case into the hosel can be changed by changing attaching arrangements of the elongated projecting portion to the shaft case between an attaching arrangement in which the elongated projecting portion is brought into engagement with the recess portion and an attaching arrangement in which the elongated projecting portion is brought into abutment with the upper end face of the hosel.

A plurality of recess portions which are different in depth from each other may be provided as the recess portion, and a depth of at least one of the recess portions may be smaller than a length of the elongated projecting portion defined along the direction in which the elongated projecting portion extends.

A plurality of recess portions may be provided of which a depth is smaller than the length of the elongated projecting portion defined along the direction in which the elongated projecting portion extends.

The golf clubs according to the first and second aspects of the invention enable the adjustment of the inserting depth of the shaft case into the hosel, and therefore, when applied to a golf club having the same head and the same shaft, it is possible to easily find out a length of the golf club which is suitable for the player by changing the inserting depths of the shaft case.

In the golf clubs according to the first and second aspects of the invention, the shaft case is inserted into the hosel hole, and the shaft case is fixed to the head by the bolt which is inserted from the sole side of the head, and therefore, the necessity of the plurality of annular screw members in JP-A-2010-213859 is eliminated, the production costs being thereby reduced.

In the golf club according to the first aspect of the invention, by changing the attaching position of the stopper member to the shaft case (the position in the direction of the axis of the shaft case), the inserting depth of the shaft case and the shaft secured to the shaft case into the hosel hole can be changed arbitrarily and continuously. The separate members do not have to be attached or detached in changing the attaching position of the stopper member. Consequently, there is no such situation that the weight of the head is increased even when the inserting depth of the shaft case is increased.

The stopper member has the cylindrical or ring shape, and the stopper member is fitted on the shaft case and is then fixed to the shaft case by the bolt. In this configuration, the bolt is loosened so that the stopper member can easily be moved to an arbitrary position.

The upper portion and upper end face of the shaft case are covered by the stopper member, whereby it is possible to aesthetically increase the external appearance of the periphery of the hosel.

The surface of the outer surface of the shaft case with which the distal end of the bolt is brought into abutment is made into the flat surface, whereby it is possible to fix the shaft case to the head more firmly.

The groove extending in the direction of the axis of the shaft case and the projecting groove portion which projects sideways from the groove are provided in the shaft case. Then, by bringing the distal end of the bolt into abutment with the deep bottom surface of the projecting groove portion, it is possible to restrain the shaft case from moving in the direction of the axis thereof.

It is possible to prohibit the rotation of the shaft case relative to the hosel hole by making the inner circumferential surface of the hosel hole and the outer circumferential surface of the shaft case into the non-cylindrical surface.

The nut is used for the stopper member and is screwed on the external screw thread formed on the upper portion of the shaft case. Then, by moving the nut in the direction of the axis of the shaft case, the inserting depth of the shaft case can also be changed arbitrarily and continuously.

In the golf club according to the second aspect of the invention, it is possible to change the inserting depth of the shaft case into the hosel hole by switching the engagement and disengagement of the elongated projecting portion with and from the recess portion in the hosel or bringing the elongated projecting portion into engagement with the recess portions having different depths. It is possible to change the inserting depth of the shaft case in multiple stages of three or more stages by providing the plurality of recess portions having different depths.

BRIEF DESCRIPTION OF THE DRAWINGS

The present invention will become more fully understood from the detailed description given hereinbelow and the accompanying drawing which is given byway of illustration only, and thus is not limitative of the present invention and wherein.

DETAILED DESCRIPTION OF THE INVENTION

Figure 1:
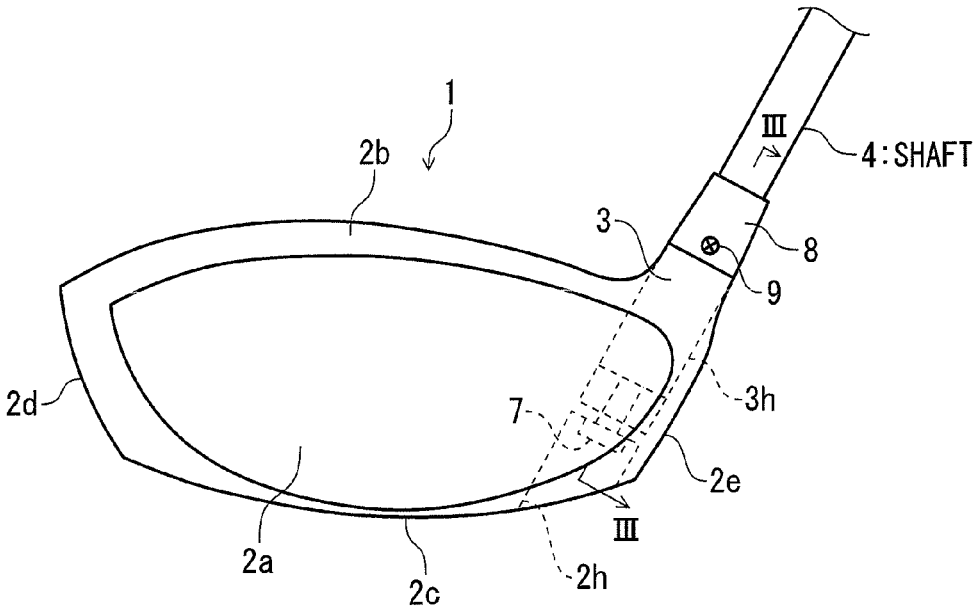
FIG. 1 is a front view of a head and its vicinity of a golf club according to an embodiment.
Figure 2:
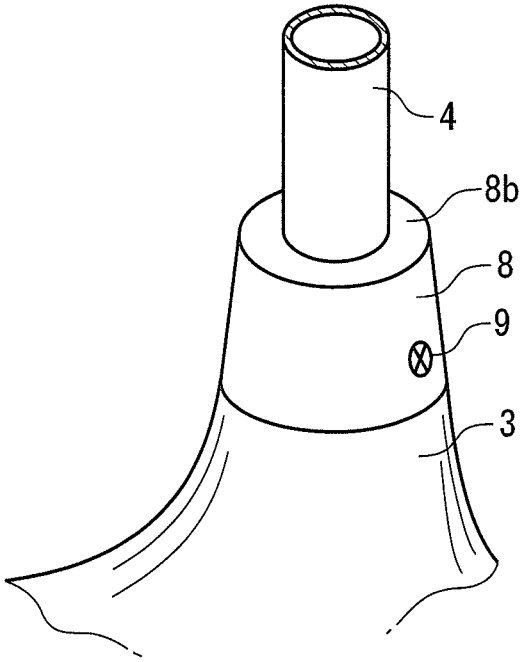
FIG. 2 is a perspective view of a hosel and its vicinity of the golf club shown in FIG. 1.

Hereinafter, embodiments will be described by reference to the drawings.

FIGS. 1 to 5 show a golf club according to a first embodiment.

This golf club is such that a shaft 4 is attached to a hosel 3 of a head 1 via a shaft case 5, a draw-in bolt 7, a top cover 8 as a stopper member and a tightening bolt 9.

This head 1 is a hollow wood-type head and has a face portion 2*a*, a crown portion 2*b*, a sole portion 2*c*, a toe portion 2*d*, a heel portion 2*e* and a back portion 2*f*.

Figure 3:
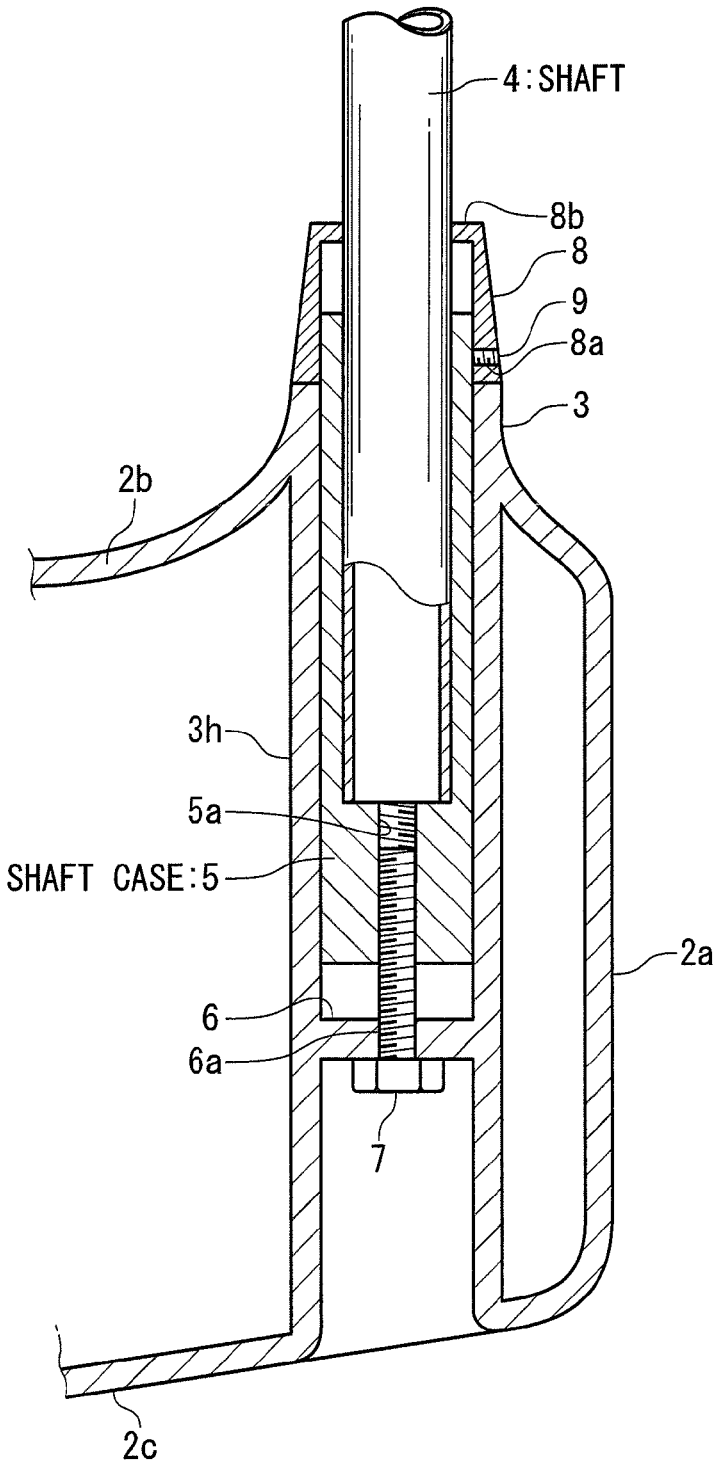
FIG. 3 is a sectional view taken along the line in FIG. 1.

As shown in FIG. 3, the hosel 3 is provided on the crown portion 2*b* in a position situated close to the face portion 2*a* and the heel portion 2*e*. A cylindrical portion 3*h* having the same bore diameter as that of the hosel 3 extends continuously from the hosel 3 as far as the sole portion 2*c* in a coaxial fashion. The shaft case 5 is inserted into an interior of the cylindrical portion 3*h*. A partition plate portion 6 is provided in the cylindrical portion 3*h* so as to be normal to the direction of an axis of the cylindrical portion 3*h*. Then, the draw-in bolt 7 is inserted through an opening 6*a* provided in the partition plate portion 6 from bottom to top to thereby be screwed in an internally screw threaded hole 5*a* of the shaft case 5.

Figure 4:
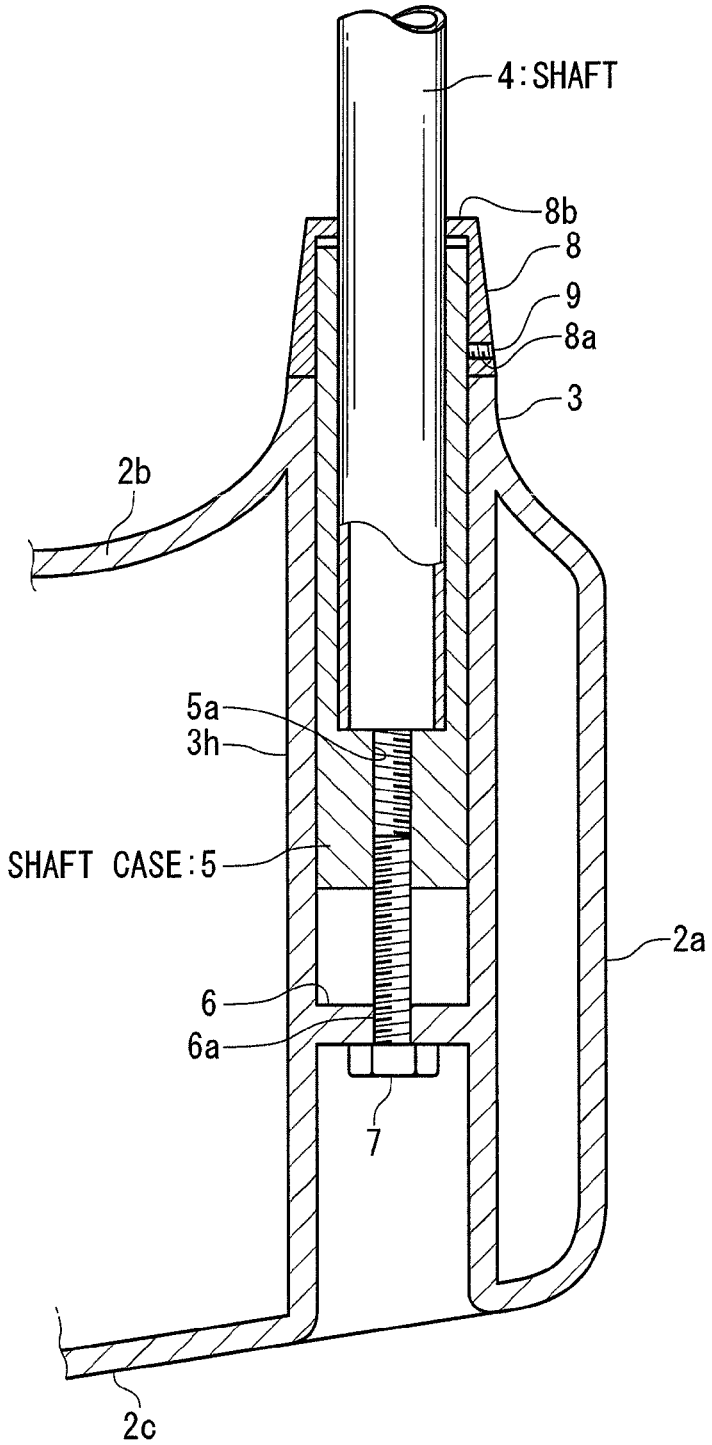
FIG. 4 is a sectional view of the same portion as the portion of the golf club shown in FIG. 3 showing a state resulting when an inserting depth of a shaft is small.
Figure 5:
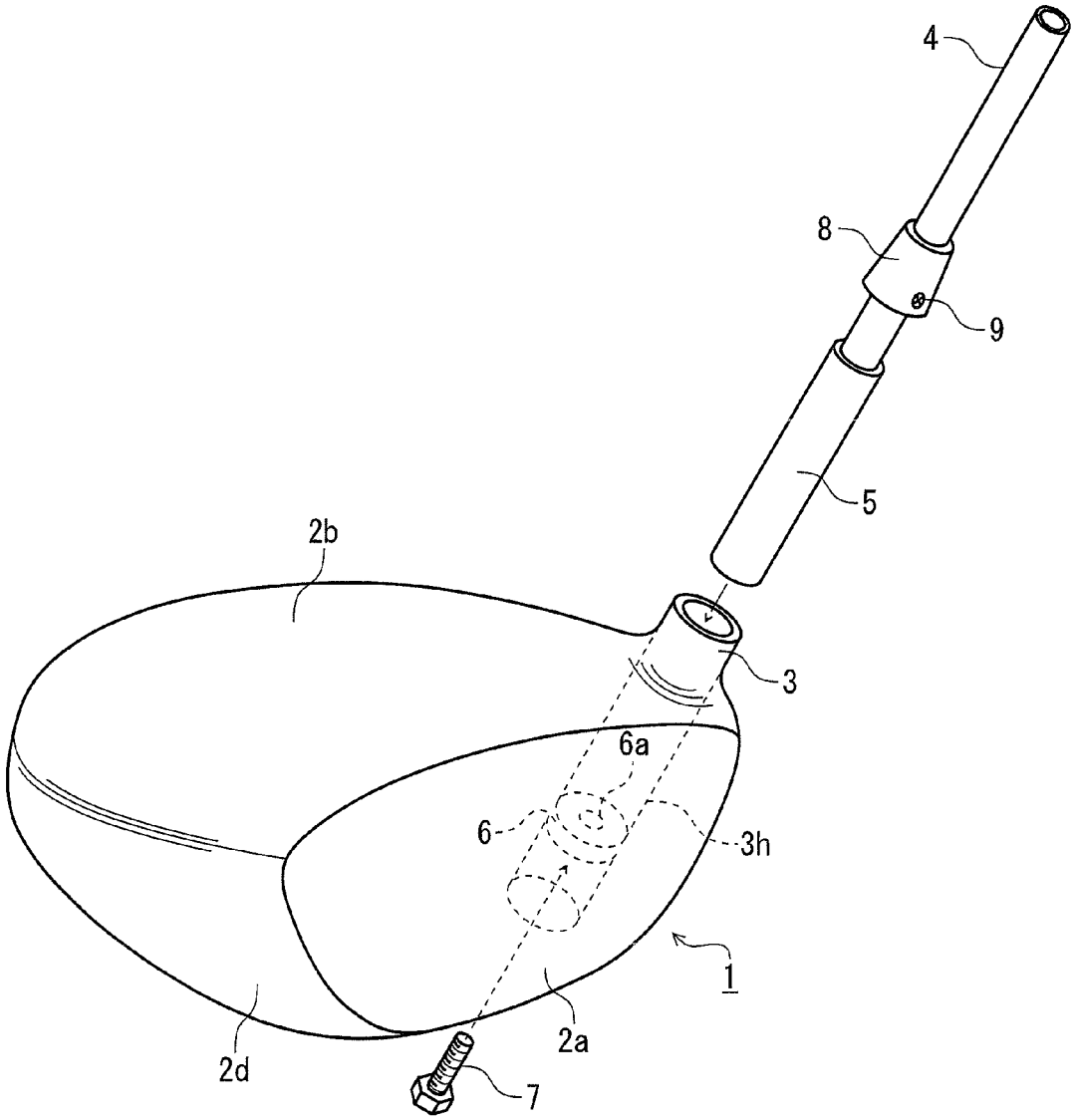
FIG. 5 is an exploded perspective view of the golf club shown in FIG. 1.

As shown in FIGS. 3 to 5, the shaft case 5 is a cylindrical member having a diameter which is extremely slightly smaller than the bore diameter of the cylindrical portion 3*h*, and an insertion hole for the shaft 4 is provided in the shaft case 5 so as to extend from an upper end towards a lower end thereof. The shaft 4 is inserted in this hole and is secured to the shaft case 5 with an adhesive. This hole has a depth of 10 mm or deeper and the depth is preferably in the range of 10 to 50 mm and is more particularly in the range of 20 to 40 mm. Then, the internally screw threaded hole 5*a* is provided so as to extend from a deep bottom surface of this hole to a lower end face of the shaft case 5.

The top cover 8 has a substantially cylindrical shape, and an outside diameter of a lower end portion is the same as an outside diameter of an upper end of the hosel 3. In this embodiment, the top cover 8 is moderately tapered so that an outer circumferential surface contracts gradually in diameter as it extends upwards . An inner circumference of the top cover 8 is made into a cylindrical surface whose bore diameter is extremely slightly larger than an outside diameter of the shaft case 5, enabling the entrance of the shaft case 5. An internally screw threaded hole 8*a* is provided in a lower portion of the top cover 8, and the tightening bolt 9 is screwed thereinto. This tightening bolt 9 is allowed to be screwed ahead in a radial direction of the top cover 8. It should be noted that although the internally screw threaded hole 8*a* and the tightening bolt 9 are each provided only one in this embodiment, a plurality of internally screw threaded holes 8*a* may be provided at intervals in a circumferential direction and an equal number of tightening bolts 9 to the internally screw threaded holes 8*a* so provided may be provided.

A flange portion 8*b*, which is directed radially inwards, is provided on an upper end face of the top cover 8.

In fabricating the golf club, as shown in FIG. 5, the top cover 8 is fitted on the shaft 4 from a distal end side and is moved to an upward position on the shaft 4. Thereafter, the shaft case 5 is secured to a distal end of the shaft 4 with the adhesive. Thus, a shaft case and shaft assembly is prepared. Preferably, the adhesive is applied to an outer circumferential surface of a distal end portion of the shaft 4 and the shaft 4 is inserted into a deepest portion of the shaft case 5.

Since the internally screw threaded hole 5*a* is provided in the shaft case 5, air passes through the internally screw threaded hole 5*a* to flow out of the shaft case 5 when the shaft 4 is inserted into the shaft case 5. An epoxy resin based adhesive is suitable for use in this embodiment.

In this way, the shaft case 5 of the shaft case and shaft assembly which includes the top cover 8 is inserted into the hosel hole (the cylindrical portion 3*h*). Then, after the shaft 4 is inserted to a desired inserting depth, a lower end face of the top cover 8 is brought into abutment with an upper end face of the hosel 3. Following this, the tightening bolt 9 is turned to press a distal end thereof against an outer circumferential surface of the shaft case 5, so that the top cover 8 and the shaft case are integrated with each other. Thereafter, the draw-in bolt 7 is passed through the opening 6*a* to be screwed into the internally screw threaded hole 5*a*. Then, the draw-in bolt 7 is tightened so sufficiently to draw the shaft case 5 towards the partition plate portion 6.

By doing so, as shown in FIGS. 3, 4, the shaft case 5 is fixed to the head 1. Since the shaft case 5 and the shaft 4 are bonded together strongly and rigidly with the adhesive, the golf club is completed in which the shaft 4 and the head 1 are integrated with each other.

In the aforesaid description, while the draw-in bolt 7 is described as being screwed into the internally screw threaded hole 5*a* in the final stage, a configuration may be adopted in which a distal end of the draw-in bolt 7 is screwed shallow into the internally screw threaded hole 5*a* after the shaft case 5 is inserted into the hosel cylindrical portion 3*h*, and after the top cover 8 and the shaft case 5 are integrated with each other, the draw-in bolt 7 is tightened again so as to be screwed deep into the internally screw threaded hole 5*a* to thereby draw the shaft case 5 towards the partition plate portion 6.

When the shaft 4 is inserted deep or the inserting depth of the shaft 4 is increased, the tightening bolt 9 is loosened, and thereafter, shaft 4 is pushed in a desired distance to move the shaft case 5 downwards in FIG. 3. Following this, the tightening bolt 9 is tightened to integrate the shaft case 5 with the top cover 8. Thereafter, the draw-in bolt 7 is turned to draw the shaft case 5 towards the partition plate portion 6.

When the inserting depth of the shaft 4 is decreased, after the draw-in bolt 7 and the tightening bolt 9 are loosened, the shaft 4 is pulled out a desired distance to move the shaft case 5 upwards in FIG. 3. Following this, the tightening bolt 9 is tightened to integrate the shaft case 5 with the top cover 8, and thereafter, the draw-in bolt 7 is turned to draw the shaft case 5 towards the partition plate portion 6. FIG. 4 shows a state in which the shaft inserting depth is decreased further than a state shown in FIG. 3.

By changing the inserting depth of the shaft 4 into the hosel 3 in this way, the length of the golf club 1 can be changed.

In this embodiment, the inserting depth of the shaft case 5 into the hosel hole (the cylindrical portion 3*h*) can be changed arbitrarily, whereby the inserting depth of the shaft can be changed or adjusted continuously and in a stepless fashion.

In this embodiment, the shaft of the golf club can also be replaced easily. In replacing the shaft of the golf club, in advance a top cover 8 which is of the same type as the top cover 8 currently used is fitted on a golf club shaft that is to replace the shaft currently used and a shaft case 5 which is of the same type as the shaft case 5 currently used is secured to the replacement shaft with an adhesive.

The draw-in bolt 7 of the currently used golf club is removed, and the shaft case 4 and the shaft case 5 which are currently used are both removed from the head 1. Following this, the replacement shaft with the top cover and the shaft case (the shaft case and shaft assembly) is inserted into the head 1. Thereafter, the top cover 8 is integrated with the shaft case 5 in the same manner as that described above, and the draw-in bolt 7 is then turned to draw the shaft case 5 to fix it in place.

In this way, according to the embodiment, the attachment or replacement of the shaft can be executed extremely easily and quickly. In replacing shafts in the conventional golf club, the hosel portion is heated to break the texture of the hardened adhesive, and the currently used shaft is pulled out of the head. Thereafter, a replacement shaft is secured in place in the head with an adhesive. Thus, it takes approximately several hours to one day. However, in the first embodiment, by fitting the top cover 8 on the replacement shaft and the shaft case 5 is attached thereto with the adhesive in advance, the replacement of shafts can be executed in the order of several minutes. Consequently, according to the embodiment of the invention, it is possible to realize an application in which various types of replacement shafts with a top cover and a shaft case are prepared, and those different shafts are attached to the same head 1 sequentially for test striking.

The shaft case, top cover and bolts are preferably made of metal and are more preferably made of, in particular, aluminum, titanium or an alloy thereof.

There is imposed no specific limitation on the material of the head. However, in the case of a wood-type golf club head, for example, a titanium alloy, an aluminum alloy or stainless steel can be used.

Figure 6:
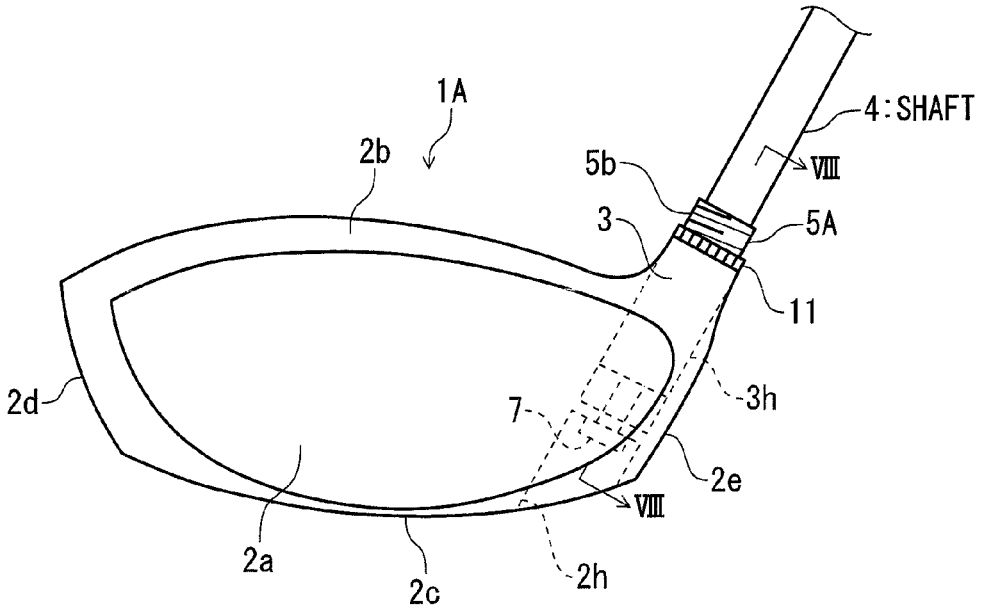
FIG. 6 is a front view of a head and its vicinity of a golf club according to another embodiment.
Figure 7:
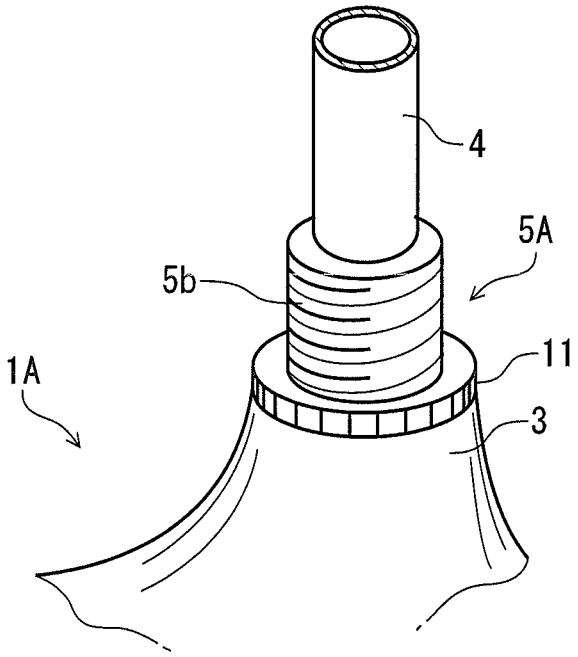
FIG. 7 is a perspective view of a hosel and its vicinity of the golf club shown in FIG. 6.
Figure 8:
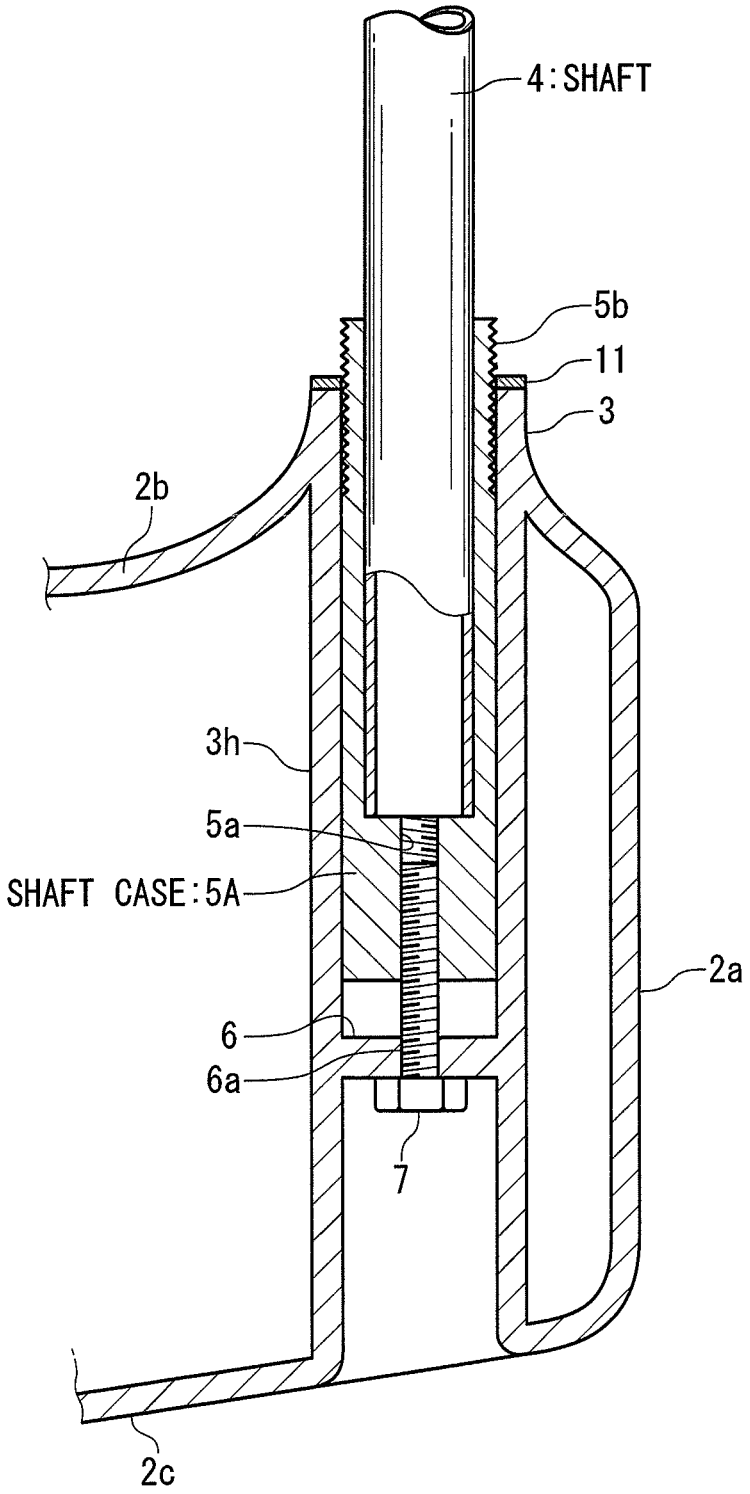
FIG. 8 is a sectional view taken along the line VII-VII in FIG. 6.
Figure 9:
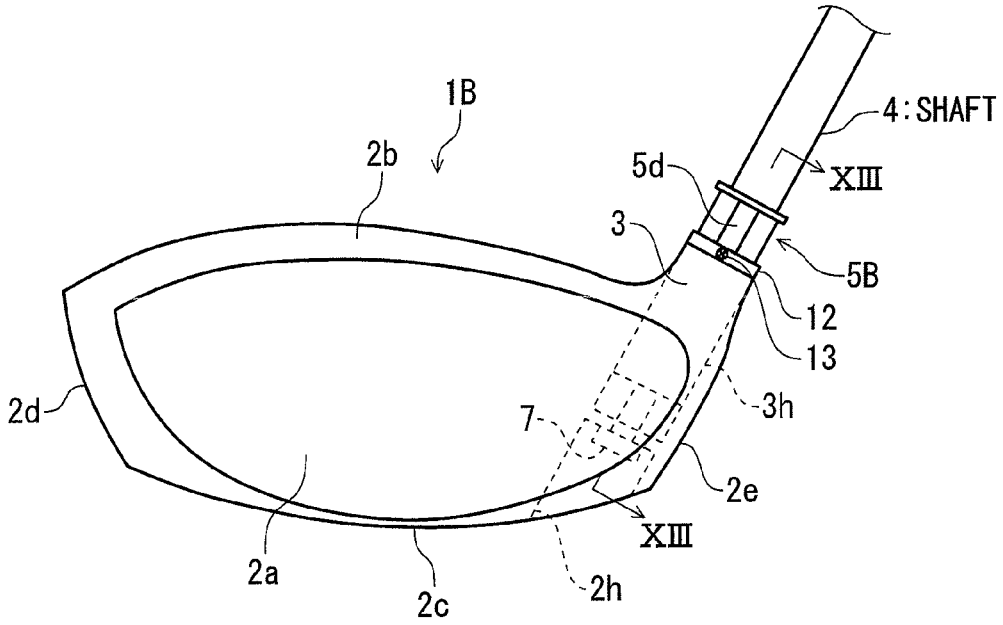
FIG. 9 is a front view of a head and its vicinity of a golf club according to a further embodiment.
Figure 10:
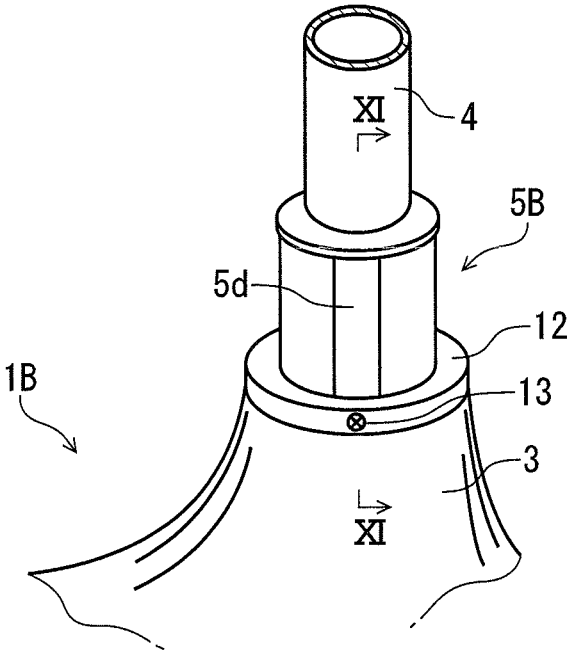
FIG. 10 is a perspective view of a hosel and its vicinity of the golf club shown in FIG. 9.
Figure 11:
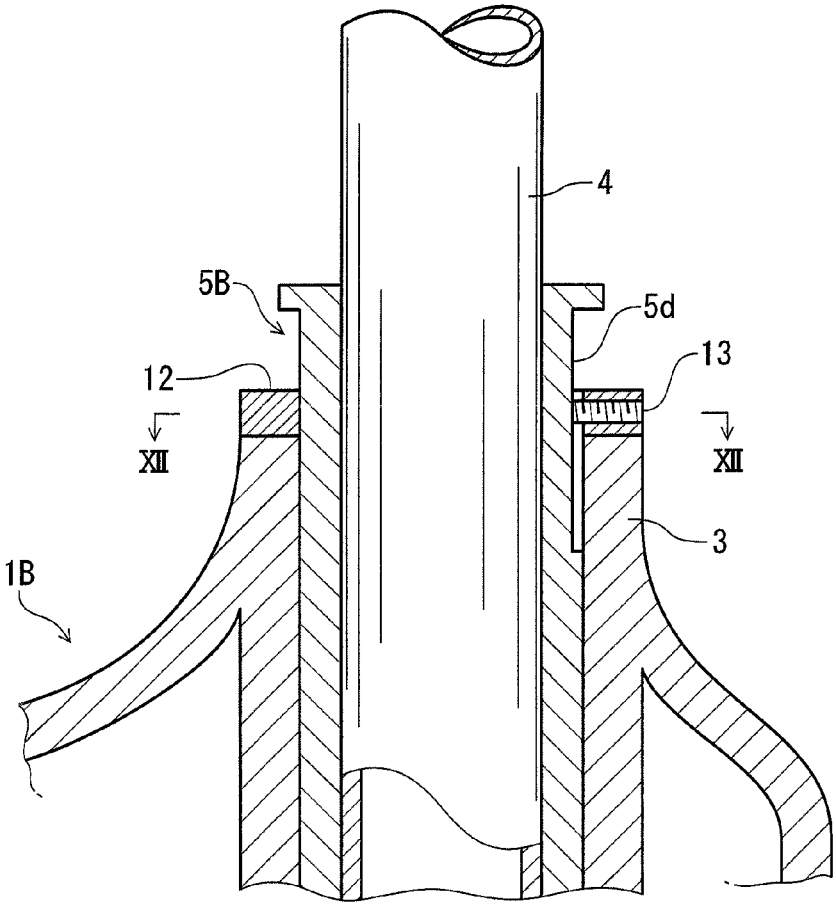
FIG. 11 is a sectional view taken along the line XI-XI in FIG. 10.

Referring to FIGS. 6 to 8, a second embodiment will be described.

This golf club of the second embodiment utilizes a shaft case 5A in which an external screw thread 5*b* is formed in on an outer circumferential surface of an upper portion thereof. A positioning nut 11 as a stopper member is screwed on this external screw thread 5*b*. The nut 11 is turned to be disposed in a desired position, and thereafter, a draw-in bolt 7 is turned to draw the shaft case 5A towards a partition plate portion 6, whereby the shaft case 5A is fixed to a head 1A. Since the position of the nut 11 can be changed arbitrarily, an inserting depth of a shaft 4 can be adjusted continuously and in a stepless fashion.

In FIGS. 6 to 8, while only one nut 11 is screwed on the external screw thread 5*b*, a double nut method may be adopted in which two nuts are screwed on the external screw thread 5*b* to thereby prevent a lower nut (a nut close to a hosel 3) from being loosened. Although the illustration thereof is omitted, a cover may be provided so as to conceal the external screw thread 5*b* which project upwards from the nut 11. As this cover, a cover is preferable which has the same shape as that of the top cover 8 and in an inner circumferential surface of which an internal screw thread is provided. By screwing the internal screw thread on the external screw thread 5*b*, the cover is detachably attached to the shaft case 5A.

The other configurations shown in FIGS. 6 to 8 are the same as those of the embodiment shown in FIGS. 1 to 5, and like reference numerals denote like portions.

Referring to FIGS. 9 to 14, a third embodiment will be described.

This golf club of the third embodiment includes a flat surface 5*d* which is provided on an outer circumferential surface of an upper portion of a shaft case 5B so as to extend in a vertical direction (a direction parallel to an axis of the shaft case 5B). A ring 12 is fitted on an upper portion of the shaft case 5B as a stopper member. An internally screw threaded hole 12*a* (FIG. 12) is provided in the ring 12 so as to penetrate it in a radial direction, and a tightening bolt 13 is screwed into the internally screw threaded hole 12*a*.

To adjust an inserting depth of the shaft case 5B, the ring 12 is disposed in a predetermined position by loosening the tightening bolt 13, and thereafter, the tightening bolt 13 is tightened to fix the ring 12. Following this, a draw-in bolt 7 is turned to draw the shaft case 5B towards a partition plate portion 6, whereby the shaft case 5B is fixed to a head 1B. Since the position of the ring 12 can be changed arbitrarily, an inserting depth of a shaft 4 can be adjusted continuously and in a stepless fashion.

Figure 12:
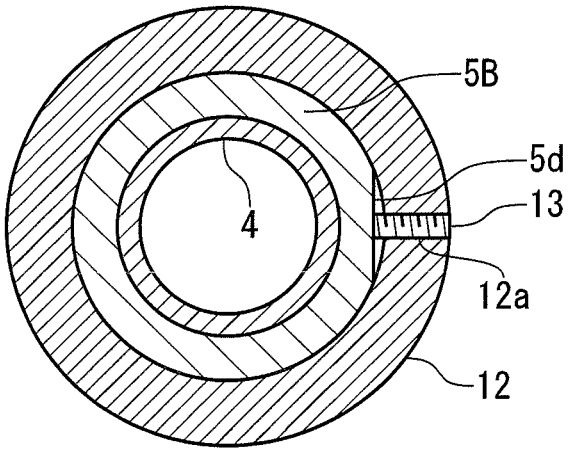
FIG. 12 is a sectional view taken along the line XII-XII in FIG. 11.
Figure 13:
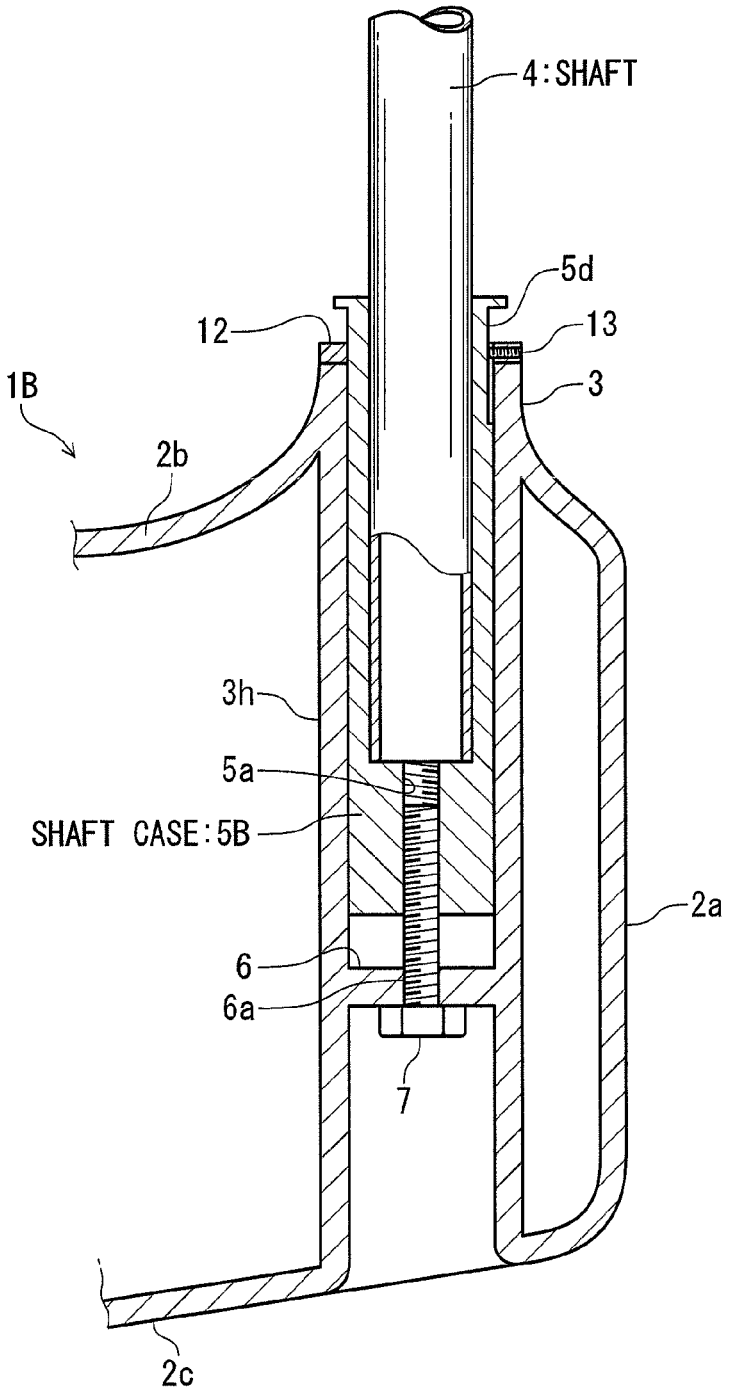
FIG. 13 is a sectional view taken along the line XIII-XIII in FIG. 9.
Figure 14:
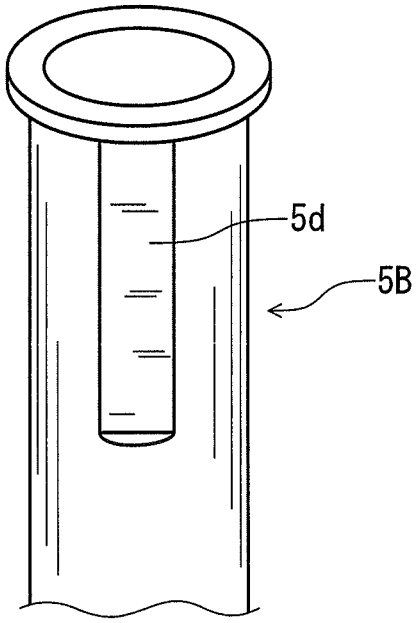
FIG. 14 is a perspective view of an upper portion of a shaft case of the golf club shown in FIGS. 9 to 13.
Figure 15:
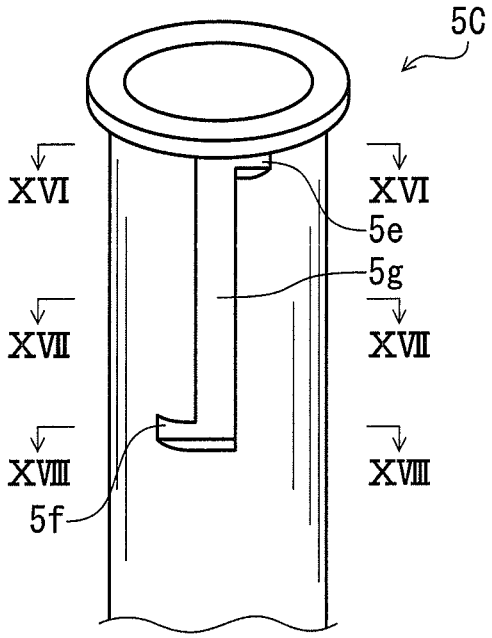
FIG. 15 is a perspective view of an upper portion of a shaft case of a golf club according to an embodiment.
Figure 16:
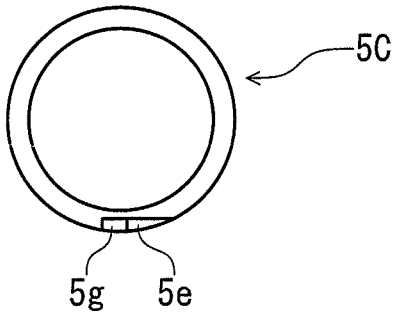
FIG. 16 is a sectional view taken along the line XVI-XVI in FIG. 15.
Figure 17:
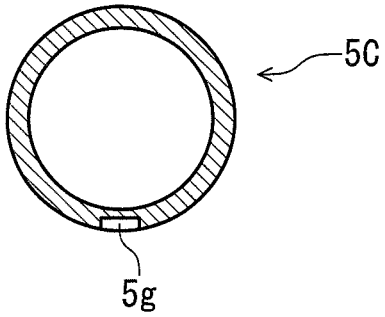
FIG. 17 is a sectional view taken along the line XVII-XVII in FIG. 15.
Figure 18:
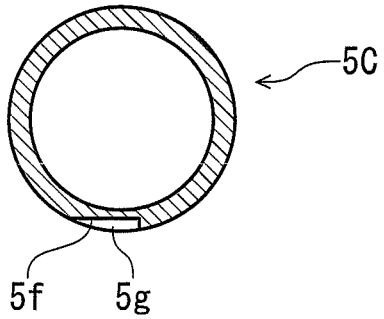
FIG. 18 is a sectional view taken along the line XVIII-XVIII in FIG. 15.

By bringing a distal end of the tightening bolt 13 into abutment with the flat surface 5*d* as shown in FIG. 12, the ring 12 is fixed to the shaft case 5B firmly by the tightening bolt 13. By bringing the tightening bolt 13 into abutment with the flat surface 5*d*, the rotational direction of the shaft case 5B can be fixed strongly and rigidly.

The other configurations shown in FIGS. 9 to 14 are the same as those shown in FIGS. 1 to 5, and like reference numerals denote like portions.

In the invention, the flat surface 5*d* of the shaft case 5B shown in FIGS. 9 to 14 may take the form of a groove. In this case, a projecting groove portion may be provided further which project sideways from the groove. FIGS. 15 to 18 show the configuration of an upper portion of a shaft case 5C which has a groove and projecting groove portions.

A groove 5*g* is provided in an outer circumferential surface of an upper portion of the shaft case 5C so as to extend in a vertical direction (a direction parallel to an axis of the cylindrical shaft case 5C). A projecting groove portion 5*e* is provided so as to project in one sideways direction from an upper portion of the groove 5*g*. Additionally, a projecting groove portion 5*f* is provided so as to project in the other sideways direction from a lower portion of the groove 5*g*. The tightening bolt 13 may be screwed into the internally screw threaded hole 12*a* so as to be brought into abutment with a deep bottom surface (a flat surface which is parallel to the axis) of the groove 5*g* or may be screwed in the same manner so as to be brought into abutment with a deep bottom surface of the projecting groove portion 5*e* or 5*f*. In the case of the tightening bolt 13 being brought into abutment with the deep bottom surface of the projecting groove portion 5*e* or 5*f*, since the tightening bolt 13 enters the projecting groove portion 5*e* or 5*f*, the vertical motion of the shaft case 5C is restrained.

Figure 19A:
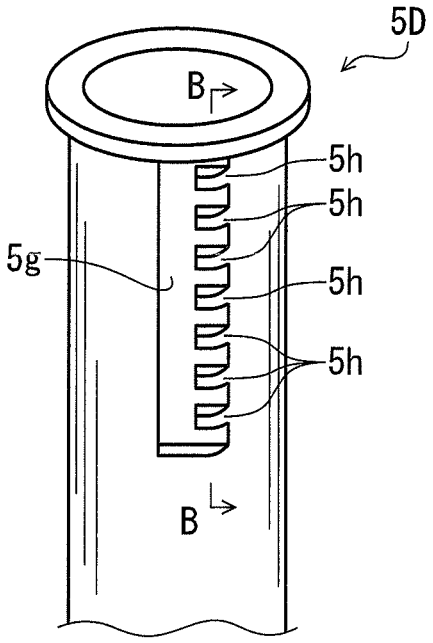
FIG. 19A is a perspective view of an upper portion of a shaft case of a golf club of another embodiment.
Figure 19B:
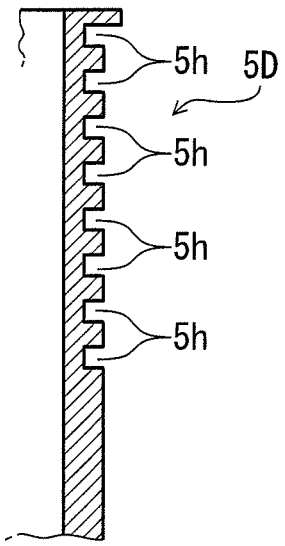
FIG. 19B is a sectional view taken along the line B-B in FIG. 19A.

While the projecting groove portions 5*e*, 5*f* are provided only in the upper portion and the lower portion of the groove 5*g* in FIGS. 15 to 18, as in a shaft case 5D shown in FIGS. 19A and 19B, projecting groove portions 5*h* may be provided in multiple stages in a vertical direction. As this occurs, the tightening bolt 13 is preferably screwed inwards so as to be brought into abutment with a deep bottom surface of any of the projecting groove portions 5*h*.

When using this shaft case 5D, it is possible to adjust an inserting depth of the shaft 4 in multiple stages according to intervals at which the projecting groove portions 5*h* are arranged.

Figure 20:
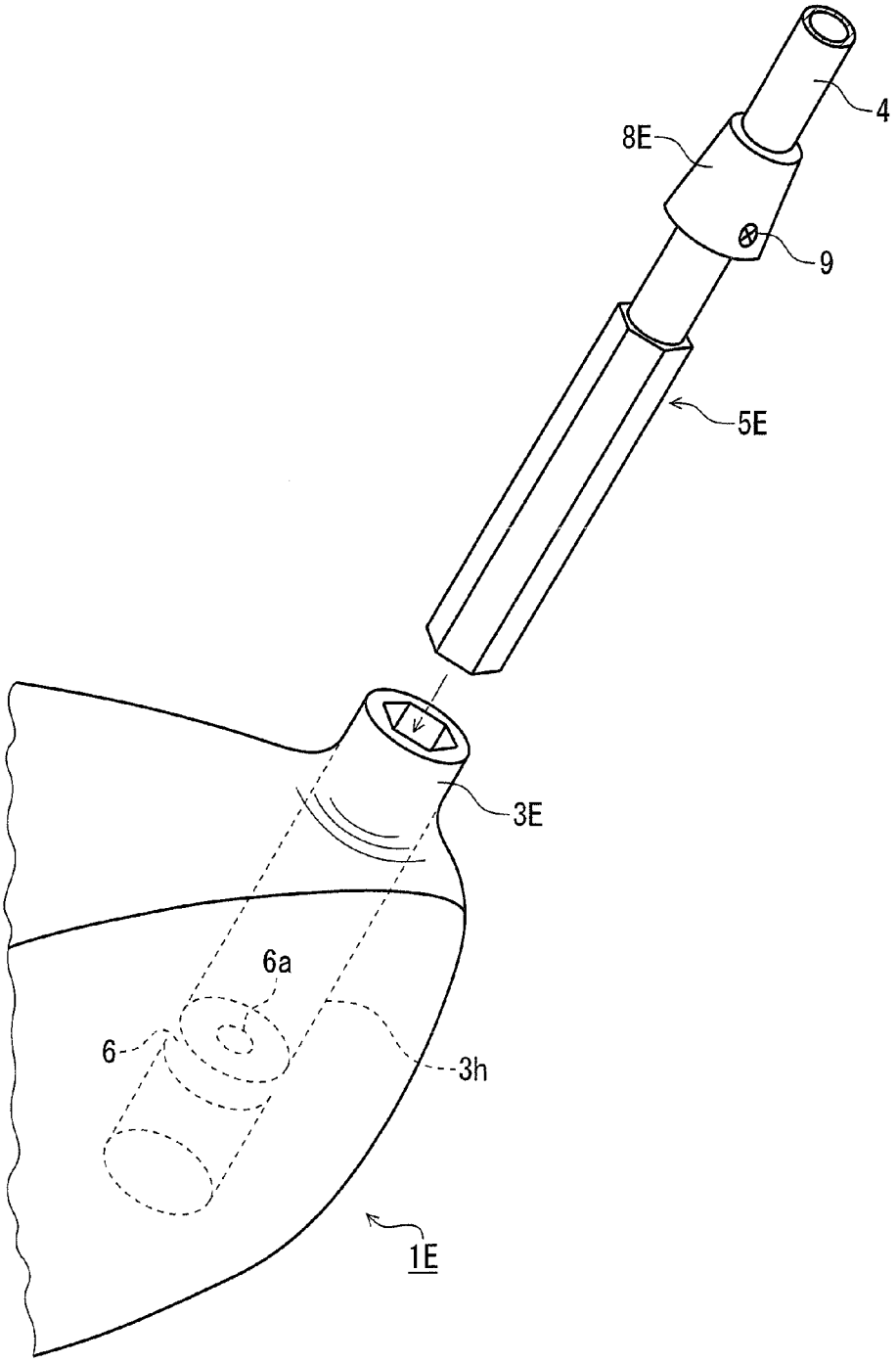
FIG. 20 is an exploded perspective view of a golf club according to a further embodiment.
Figure 21:
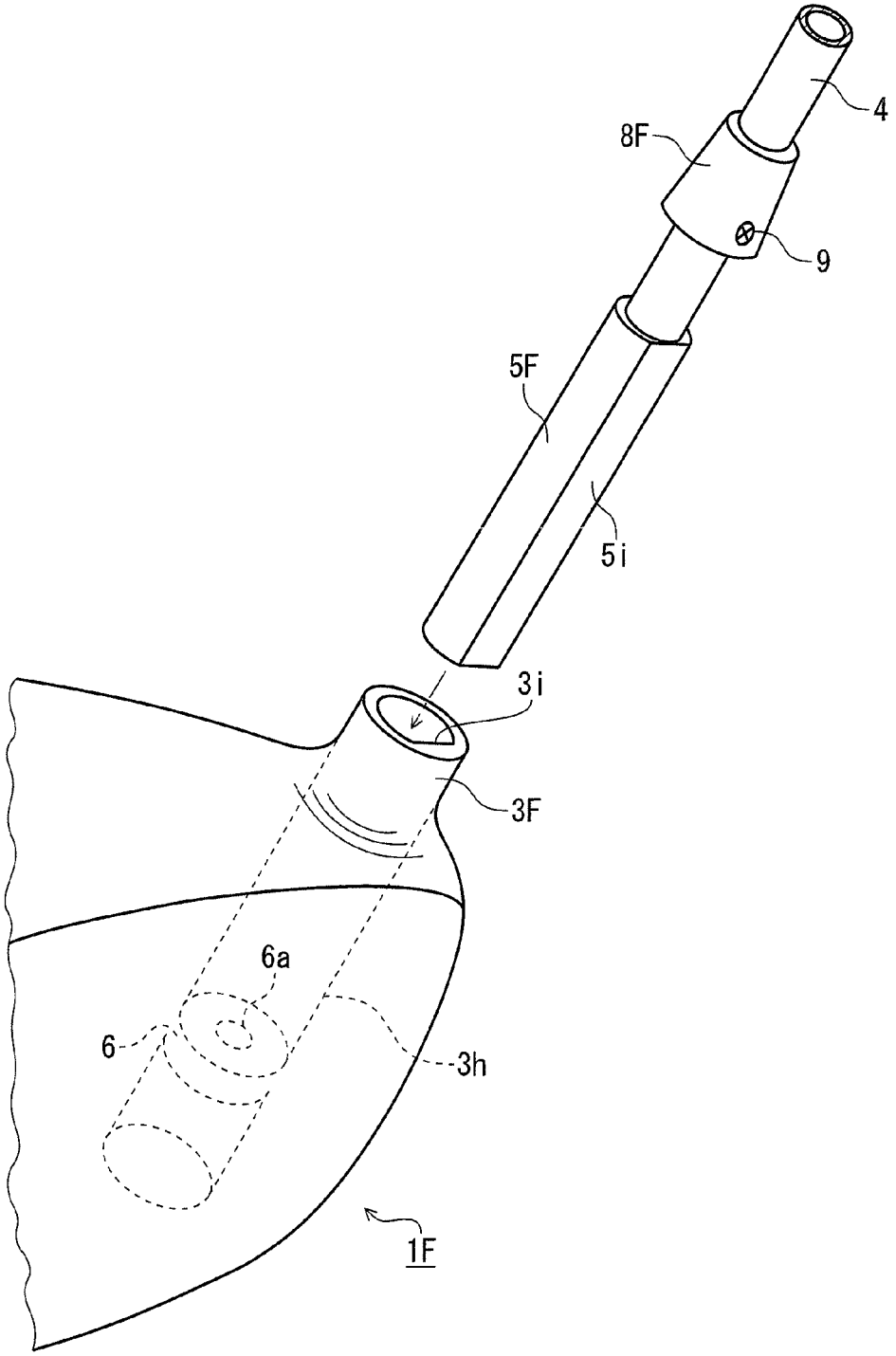
FIG. 21 is an exploded perspective view of a golf club according to an embodiment.

In the embodiments, while the outer circumferential surface of the shaft case and the inner circumferential surface of the hosel 3 are cylindrical or round in cross section, as shown in FIGS. 20, 21, the shaft case and the hosel 3 may be constructed into a non-cylindrical shape so as to prevent the rotation of the shaft case.

In a head 1E shown in FIG. 20, an outer circumferential surface of a shaft case 5E and an inner circumferential surface of a hosel hole in a hosel 3E have a hexagonal prism shape. Although the illustration thereof is omitted, an interior hole of a top cover 8E has also a hexagonal shape in cross section.

In a head 1F shown in FIG. 21, an outer circumferential surface of a shaft case 5F and an inner circumferential surface of a hosel 3F have a C-like shape in cross section which results from cutting part of a cylinder in the direction of a chord to provide flat surfaces 5*i*, 3*i*. Although the illustration thereof is omitted, an inner circumferential surface of a top cover 8F also has a C-like shape in cross section.

The other configurations shown in FIGS. 20, 21 are the same as those shown in FIGS. 1 to 5, and like reference numerals denote like portions.

Figure 22:
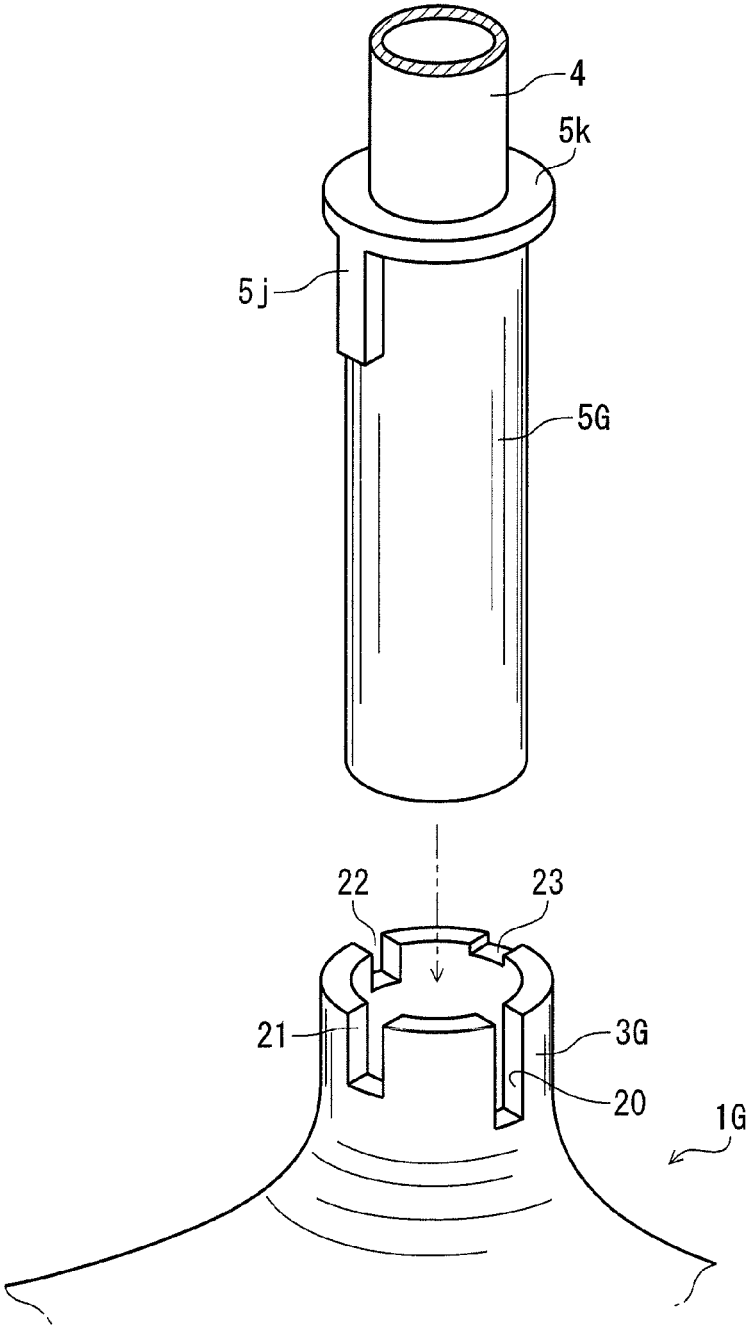
FIG. 22 is an exploded perspective view of a golf club according to another embodiment.

FIG. 22 is an exploded perspective view of a hosel and its vicinity of a golf club head according to another embodiment.

Four recess portions 20 to 23 are provided in a hosel 3G of this head which are cut axially inwards from an upper end surface of the hosel 3G. The depth of the recess portions 20, 21, 22, 23 so cut decreases sequentially in this order. An elongated projection portion 5*j* is provided on a shaft case 5G so as to extend downwards from a flange 5*k* at an upper end portion of the shaft case 5G to thereby be brought into engagement with the recess portions 20 to 23. A length over which the elongated projecting portion 5*j* extends is the same as the depth of the recess portion 20.

The inserting depth of a shaft 4 becomes the largest when the elongated projecting portion 5*j* is brought into engagement with the recess portion 20, and the inserting depth of the shaft 4 decreases sequentially as the elongated projecting portion 5*j* is brought into engagement with the recess portions 21 to 23 in that order. Although not shown, the shaft case 5G which is inserted into a hosel hole is fixed in place in a head 1G by a draw-in bolt 7. Since the elongated projecting portion 5*j* is in engagement with the recess portion 20, 21, 22 or 23, the rotation of the shaft 5G is prevented.

Additionally, a lower end face of the elongated projecting portion 5*j* may be brought into abutment with the upper end face of the hosel 3. As this occurs, the inserting depth of the shaft case 5G becomes the smallest.

In the invention, the inserting depth of the shaft into the hosel is changed in the multiple stages or continuously in the stepless fashion as has been described heretofore so as to change the length of the golf club. By changing the length of the golf club in this way, the center of gravity of the head and the balance of the golf club are changed. Then, in the invention, it is preferable to provide a weight adjusting portion in the head. Specifically, for example, machine screw holes are provided in the sole portion, the back portion and the side portions of the golf club head so that machine screws having different weights are mounted in the machine screw holes so as to adjust the weight of the head. By using machine screws which are different in length or material (resin such as nylon, aluminum, magnesium, titanium, an alloy thereof, stainless steel and a tungsten alloy) as the machine screws, the weight of the head can be adjusted.

To describe this feature of the invention in greater detail, in the invention, the length of the golf club can be changed by sliding the shaft case within the hosel cylindrical portion 3*h*. When the length of the golf club is increased, even with the same head weight, the value of a swing balance is increased. Because of this, a weight adjusting screw should be mounted in the sole portion 2*c*, the toe portion 2*d*, the head portion 2*e* or the back portion 2*f*. It is preferable that screws having different weights are prepared as weight adjusting screws and the screws are selectively mounted in the head so as to adjust the head weight and the swing balance. For example, when the length of the golf club is increased, the weight screw is changed from the heavy one to the light one. One or a plurality of locations are preferably selected from those described above as a weight screw mounting location. Screws of various weights can be prepared by using materials having different specific weights or using screws having different lengths.

In the embodiments, the head of the golf club is of the wood type, however, the invention can also be applied to golf cubs such as utilities, irons or putters.

What is claimed is:

1. A golf club comprising:

a shaft;

a head attached to a distal end of the shaft;

a shaft case is secured to the distal end of the shaft;

the shaft case is inserted into a hosel hole in the head; and the shaft case is fixed to the head by a bolt which is inserted from a sole side of the head, wherein:

a stopper member is attached to an outer circumference of the shaft case so that an attaching position can be changed;

the stopper member is in abutment with an upper end portion of a hosel; and an inserting depth of the shaft case into the hosel hole can be changed by changing the attaching position of the stopper member.

2. The golf club according to claim 1, wherein:

the stopper member has a cylindrical or ring shape;

a bolt is screwed in an internally screw threaded hole provided in the stopper member; and the bolt is screwed to be advanced so that a distal end thereof is pressed against the shaft case, whereby the stop member is fixed to the shaft case.

3. The golf club according to claim 2, wherein the stopper member has the cylindrical shape and covers an outer circumferential surface and an upper end face of the shaft case which projects from the hosel.

4. The golf club according to claim 2, wherein a surface of an outer surface of the shaft case with which the bolt is brought into abutment is a flat surface.

5. The golf club according to claim 4, wherein the surface with which the distal end of the bolt is brought into abutment is a deep bottom surface of a groove portion which extends in a parallel direction to the direction of an axis of the shaft case or a deep bottom surface of a projecting groove portion which projects sideways from the groove portion.

6. The golf club according to claim 1, wherein an inner circumferential surface of the hosel hole and an outer circumferential surface of the shaft case is made up of a non-cylindrical surface, and the shaft case is prohibited to rotate relative to the hosel hole.

7. The golf club according to claim 1, wherein an external screw thread is formed in an outer circumferential surface of an upper portion of the shaft case, and the stopper member is a nut which is screwed on the external screw thread.

* * * * *